US006142541A

United States Patent [19]

Rotondi

[11] Patent Number: 6,142,541

[45] Date of Patent: Nov. 7, 2000

[54] PICK RESISTANT SASH LOCK

[75] Inventor: Anthony J. Rotondi, Owatonna, Minn.

[73] Assignee: Truth Hardware Corporation, Owatonna, Minn.

[21] Appl. No.: 09/198,760

[22] Filed: Nov. 24, 1998

[51] Int. Cl.[7] ..... E05C 3/04

[52] U.S. Cl. ..... 292/241; 292/DIG. 20; 292/DIG. 47

[58] Field of Search ..... 292/4, 5, 240–242, 292/346, DIG. 20, DIG. 47, DIG. 45, 228, 128, 67; 70/417

[56] References Cited

U.S. PATENT DOCUMENTS

| | | | |
|---|---|---|---|
| D. 302,651 | 8/1989 | Mosch . | |
| 1,252,524 | 6/1918 | White | 292/346 |
| 1,275,938 | 8/1918 | Juselius | 292/346 |
| 1,899,466 | 2/1933 | Kistner | 292/DIG. 20 |
| 2,603,515 | 7/1952 | Thomas . | |
| 2,830,843 | 4/1958 | Seaburg et al. . | |
| 2,873,134 | 2/1959 | Ahlgren | 292/111 |
| 2,997,323 | 8/1961 | Riser | 292/111 |
| 3,109,675 | 11/1963 | Anderson . | |
| 3,161,923 | 12/1964 | Crain . | |
| 3,394,955 | 7/1968 | Martin . | |
| 3,560,037 | 2/1971 | Crain . | |
| 3,706,467 | 12/1972 | Martin . | |
| 3,811,718 | 5/1974 | Bates . | |
| 3,907,348 | 9/1975 | Bates et al. . | |
| 3,949,525 | 4/1976 | Bates et al. . | |
| 3,951,444 | 4/1976 | Shull . | |
| 4,059,298 | 11/1977 | Van Klompenburg . | |
| 4,095,827 | 6/1978 | Stavenau . | |
| 4,095,829 | 6/1978 | Van Klompenburg . | |
| 4,155,575 | 5/1979 | Poe . | |
| 4,223,930 | 9/1980 | Costello | 292/346 |
| 4,253,688 | 3/1981 | Hosooka | 292/52 |
| 4,261,602 | 4/1981 | Anderson . | |
| 4,389,062 | 6/1983 | Rosenberg . | |
| 4,429,910 | 2/1984 | Anderson . | |
| 4,497,135 | 2/1985 | Vetter . | |
| 4,610,472 | 9/1986 | Billingsley . | |
| 4,621,847 | 11/1986 | Paulson et al. . | |
| 4,736,972 | 4/1988 | Mosch . | |
| 4,801,164 | 1/1989 | Mosch . | |
| 4,813,725 | 3/1989 | Mosch . | |
| 4,937,976 | 7/1990 | Tucker et al. . | |
| 4,991,886 | 2/1991 | Nolte et al. . | |
| 5,054,239 | 10/1991 | Tucker et al. . | |
| 5,087,087 | 2/1992 | Vetter et al. . | |
| 5,110,165 | 5/1992 | Piltingsrud . | |
| 5,118,145 | 6/1992 | Tucker . | |
| 5,174,617 | 12/1992 | Huber | 292/128 |
| 5,219,193 | 6/1993 | Piltingsrud . | |

OTHER PUBLICATIONS

Truth Brochure for "Trimline Cam Lock" (1991) pp. 15–15a.

(List continued on next page.)

*Primary Examiner*—Flemming Saether
*Assistant Examiner*—Gary Estremsky
*Attorney, Agent, or Firm*—Lorusso & Loud

[57] ABSTRACT

A check rail lock securable to the top rail of one window sash of a double hung window, including a housing, a cam pivotable about a first axis within the housing between an open position and a locking position, a pin extending from the bottom of the cam, and a guard member disposed substantially beneath the cam and pivotable about a second axis within the housing, the guard member having a slot receiving the pin for moving between a guarding position and a retracted position responsive to pivoting of the cam between the locking position and the open position. The cam in the locking position includes a portion extending from the housing and adapted to cooperate with a keeper secured to the other window sash to lock the one window sash in a closed position relative to the other window sash. The guard member extends from the housing to substantially overlap with the cam extending portion in the guarding position and the guard member is substantially entirely retracted into the housing in the retracted position. The guard member slot is oriented whereby a force biasing the guard member from the guarding position toward the retracted position biases the pin generally toward the first axis or overcenter to bias the cam toward the locking position.

15 Claims, 2 Drawing Sheets

OTHER PUBLICATIONS

Truth Brochure for "Flush Mount Check Rail Lock" (1991) pp. 15.1–15.1A.
Truth Brochure for "Check–Rail Locks" (1991) pp. 16–16a.
Truth Brochure for "Sash Lock" (1991) pp. 13–13a.
Truth Brochure for "Concealed Casement Hardware–Lock" (1991) pp. 13.1–13.1b.
Truth Brochure for "Entrygard Cam Lock"(1991) pp. 14–14a.
Allen–Stevens Brochure for "Keyless Push Button Security Lock".
Truth Brochure for "Entrygard Sash Lock" (1991) pp. 11–11a.
Truth Brochure for "Non–Handed, Low Profile Sash Lock" (1991) pp. 12–12c.
Truth Brochure for "Low Profile Cam Lock" (1991) pp. 17–17a.
Truth Brochure for "Cam Lock" (1991) pp. 18–18a.
Truth Brochure for "Trimline Cam Lock" (1988) pp. 12–12c.
Truth Brochure for "Locking Handle" (1988) pp. 14–14e.
Truth Brochure for "Trimline Cam Handle Locks" (1988) pp. 15–15c.
Truth Brochure for "Non–Handed, Low Profile Sash Lock" (1988) pp. 15–15a.
Truth Brochure for "Multi–Point Locking System" (1989) pp. 20.1–20.1e.

PICK RESISTANT SASH LOCK

BACKGROUND OF THE INVENTION

1. Technical Field

The present invention is directed toward window sash locks, and more particularly toward pick resistant check rail sash locks for double hung windows.

2. Background Art

A check rail lock draws together meeting rails of an upper and lower sash of a double-hung window and locks the sashes against opening movement. The check rail lock has a housing which mounts a rotatable cam for movement between locked and unlocked positions and which engages a keeper in a locked position. The cam is limited to movement between the locked and unlocked positions.

Some prior art cam locks (e.g., U.S. Pat. Nos. 4,736,972 and 5,110,165) have included spring structures which releasably bias the cam toward, and retain the cam in, locked and/or unlocked positions. Such locks provide increased security, although it may still be possible for a skilled person to cause such check rail locks to open. Specifically, skilled intruders may be able to manipulate the structure with a knife or stiff wire introduced from outside the window which is capable of overcoming the biasing force of the spring structure, thereby gaining silent access to a dwelling through the double-hung window. (It should be recognized that although such locks are often used on glass windows which could be easily broken to allow the intruder to reach in and open the lock, doing so can be noisy and attract the attention of people both inside and outside the dwelling, and that risk of attention can significantly deter potential intruders who are unable to otherwise gain access by silently manipulating the lock). Still other cam locks (e.g., U.S. Pat. No. 5,219,193) have provided a mechanism for locking the handle and cam in the locked position in order to keep an intruder from opening the lock from the outside. Such locks provide enhanced security but can also make the lock more difficult to normally operate by persons inside the dwelling. For example, where a push button is used to secure the lock in position, an operator will have to do two steps to open the lock (push the button, and then turn the cam). Such operation might not be readily understood by some people, and can potentially be difficult for persons of limited mobility (e.g., with arthritis).

The present invention is directed toward overcoming one or more of the problems set forth above.

SUMMARY OF THE INVENTION

In one aspect of the present invention, a lock securable to one window sash of a double hung window is provided. The lock includes a base securable to the one window sash, a cam pivotable about a first axis relative to the base between an open position and a locking position, and a guard member movable relative to the base responsive to pivoting of the cam. The cam in the locking position includes a portion extending from the base and adapted to cooperate with a keeper secured to the other window sash to lock the one window sash in a closed position relative to the other window sash. The guard member is movable between a guarding position when the cam is in the locking position and a retracted position when the cam is in the open position, where the guard member extends from the base to substantially overlap with the cam extending portion in the guarding position and the guard member does not substantially extend from the base in the retracted position.

In a preferred form of this aspect of the present invention, the guard member is pivotably secured to the base about a second axis spaced from and substantially parallel to the first axis, and a follower connection between the cam and the guard member pivot the guard member about the second axis between the guarding position and the retracted position when the cam pivots about the first axis between the locking position and the open position.

In another preferred form, the cam pivots in a first direction about the first axis when moving from the open position to the locking position, and the follower connection is configured when the guard member is in the guarding position whereby a force biasing the guard member toward the retracted position biases the cam toward pivoting in the first direction.

In still another preferred form, the follower connection is a pin on one of the cam and the guard member and a slot receiving the pin in the other of the cam and the guard member. Further advantageously with this form, the slot is in the guard member and is oriented whereby a force biasing the guard member from the guarding position toward the retracted position biases the pin substantially toward the first axis, or the slot is oriented whereby a force biasing the guard member from the guarding position toward the retracted position biases the pin to introduce a moment force on the cam biasing the cam toward pivoting in a direction away from its open position.

In another aspect of the present invention, a check rail lock securable to the top rail of one window sash of a double hung window is provided, including a housing securable to the top rail of one window sash, a cam pivotable about a first axis within the housing between an open position and a locking position, a pin extending from the bottom of the cam, and a guard member disposed substantially beneath the cam and pivotable about a second axis within the housing spaced from and substantially parallel to the first axis, the guard member having a slot receiving the pin for moving between a guarding position and a retracted position responsive to pivoting of the cam between the locking position and the open position. The cam in the locking position includes a portion extending from the housing and adapted to cooperate with a keeper secured to the other window sash when the housing is secured to the one window sash to lock the one window sash in a closed position relative to the other window sash. The guard member extends from the housing to substantially overlap with the cam extending portion in the guarding position and the guard member is substantially entirely retracted into the housing in the retracted position.

In a preferred form of this aspect of the present invention, the guard member slot is oriented whereby a force biasing the guard member from the guarding position toward the retracted position biases the pin substantially toward the first axis.

In another preferred form, the slot is oriented whereby a force biasing the guard member from the guarding position toward the retracted position biases the pin to introduce a moment force on the cam biasing the cam toward pivoting in a direction away from its open position.

In still another preferred form, the cam pivots in a first direction about the first axis when moving from the open position to the locking position and the cam in the locking position positions the pin whereby a force biasing the guard member toward the retracted position engages the pin to bias the cam toward pivoting in the first direction.

In yet another aspect of the present invention, a lockable double hung window is provided, including a first window sash including a bottom rail with a top side and a second window sash including a top rail, the second window sash top rail being positionable adjacent the first window sash bottom rail to define a window shut position. A keeper is secured to the top side of the first window sash bottom rail, and a check rail lock is secured to the top rail of the second window sash. The check rail lock includes a cam pivotable between an open position and a locking position about a first axis fixed relative to the second window sash and a guard member movable relative to the second window sash top rail between a guarding position and a retracted position responsive to pivoting of the cam. The cam in the locking position includes a portion extending from the top rail to a position interfering with the keeper to restrict movement of one window sash relative to the other window sash, the cam being received in the keeper when the window sashes are in the window shut position. The guard member in the guarding position overlies both the first and second window sashes beneath the cam extending portion, and in the retracted position is disposed substantially entirely over the top rail of the second window sash.

In one preferred form, the guard member is pivotable beneath the cam about a second axis spaced from and substantially parallel to the first axis, and a follower connection between the cam and the guard member pivots the guard member about the second axis between the guarding position and the retracted position when the cam pivots about the first axis between the locking position and the open position.

Preferred forms of the lock such as summarized with the previously described aspects of the present invention may also be used with this aspect of the invention.

In yet another preferred form, the check rail lock includes a housing secured to the top rail of the second window sash, the first axis being defined by the housing. Advantageously with this form, the housing is open on a side facing the first window sash and the cam extending portion extends out the open side in the locking position and the guard member extends out the open side in the guarding position. Also advantageously, a post is provided pivotable about the first axis and extending through an opening in the housing, the post on its lower end being secured to the cam and on its upper end being secured to a manually engageable handle.

It is an object of the present invention to provide a window lock which can be easily and inexpensively manufactured, assembled, and installed.

It is another object of the present invention to provide a window lock which can be easily operated by a proper user at all times.

It is yet another object of the present invention to provide a window lock which will provide the maximum security possible against an attempted intruder.

It is still another object of the present invention to provide a window lock which will not inadvertently damage the other window components and will not itself be inadvertently damaged during typical use either.

DESCRIPTION OF THE PREFERRED EMBODIMENT

Figure 2:
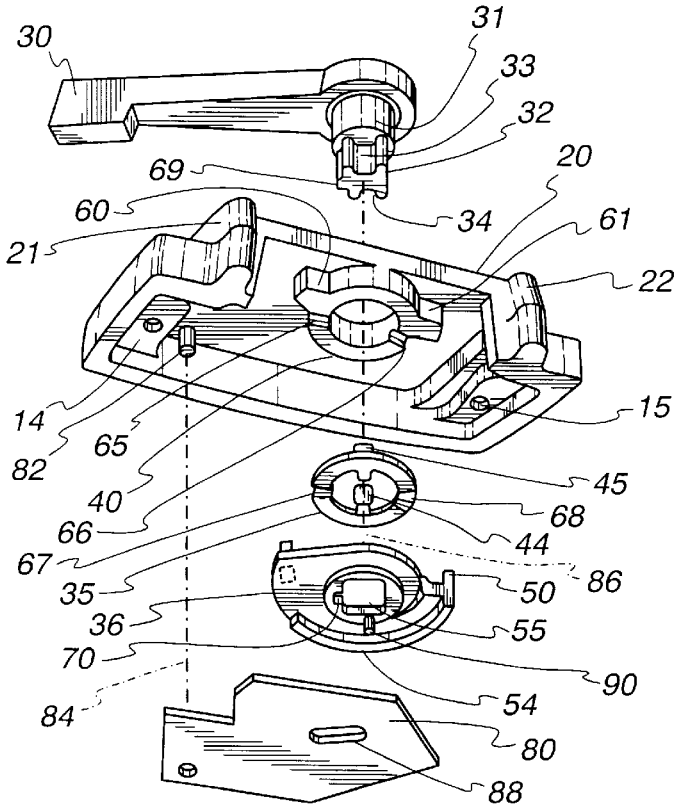
FIG. 2 is an exploded view of a check rail lock such as shown in FIG. 1 also incorporating the present invention.
Figure 3:
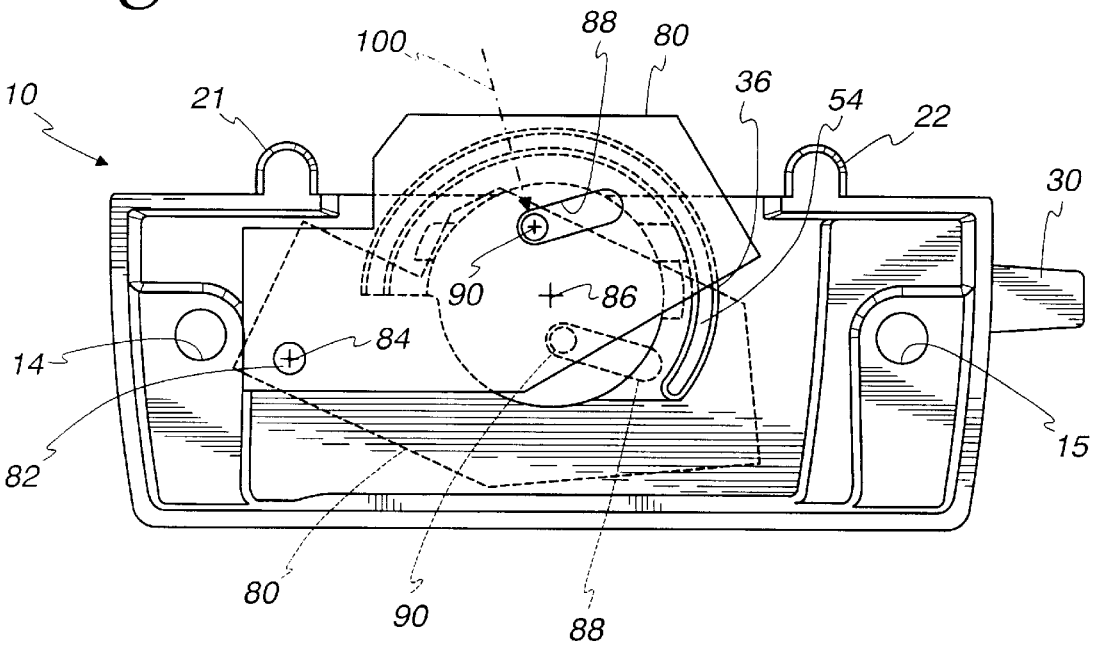
FIG. 3 is a bottom plan view of the FIG. 2 lock in the guarding position, with the guard member also shown in phantom in its retracted position.
Figure 4:
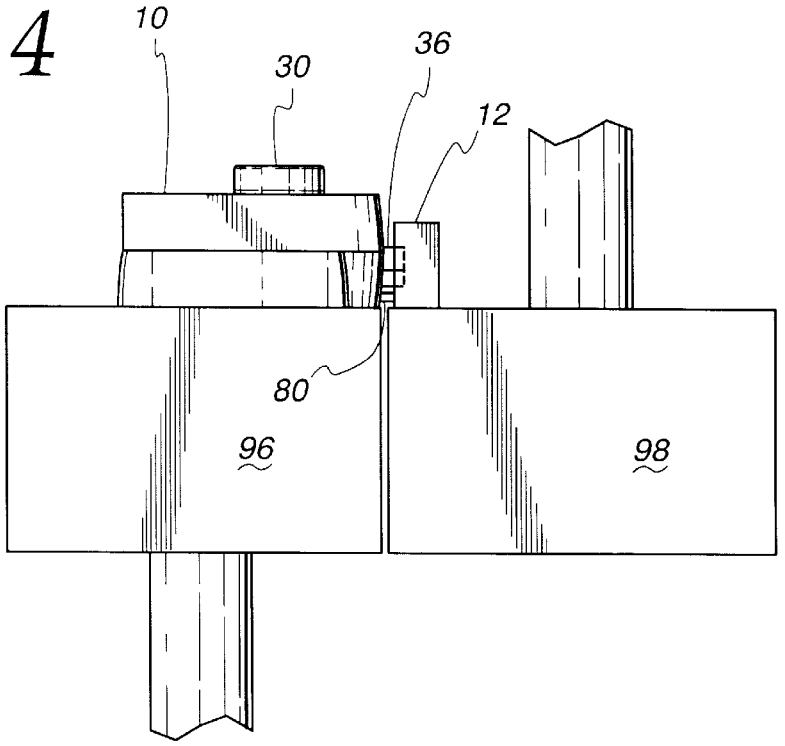
FIG. 4 is a simplified side view of two window sashes of a double hung window locked by a check rail lock incorporating the present invention.

A check rail lock embodying the present invention is shown in FIGS. 2–4. Once a complete understanding of the present invention is obtained, however, it should be realized that this invention may be used not only with new check rail locks, but with many current designs of check rail locks, and with or without various design features usable with basic such check rail locks. As such, it should be recognized that the basic check rail lock shown in the Figures is merely illustrative of one such lock with which the present invention may be incorporated, and still other locks than shown may also incorporate the present invention.

Figure 1:
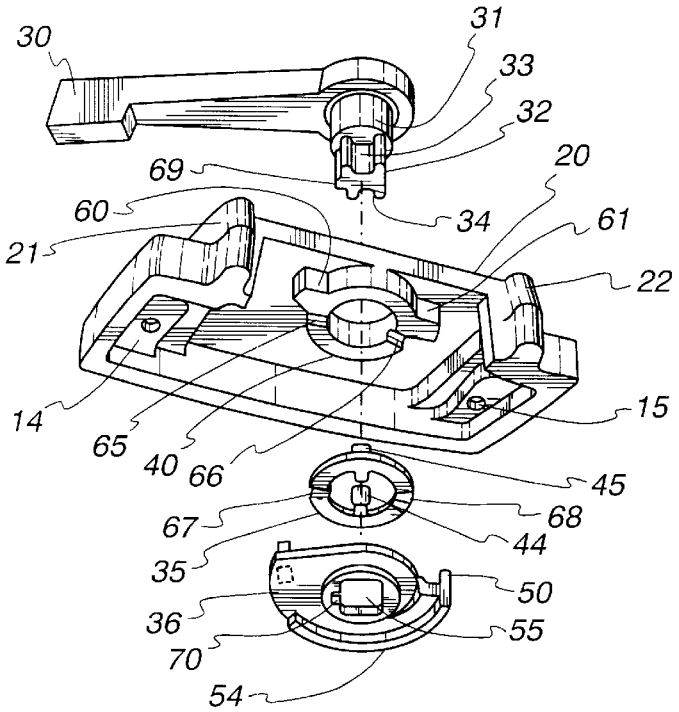
Fig. 1 (Prior Art)
FIG. 1 is a perspective view of one prior art check rail lock and keeper with which the present invention may be used.

FIG. 1, for example, illustrates one such suitable prior art lock 10 with which the present invention may be used, including a housing 11 as its base for securing to the top rail of a window sash, with the movable structure included inside the housing 11. In the preferred form, the lock base is a housing or other foundational structure to which the movable structure is secured, whereby the lock 10 may be readily installed as a single component on a window sash. However, it should be recognized that, in its broad sense, the lock base is what the movable structure is secured to and therefore in its broadest sense could include the window sash itself (e.g., in a less preferred embodiment in which the pivot axes of the movable structure are defined by directly securing them to the window sash without any intermediate foundation structure).

The lock 10 cooperates with a keeper 12 securable to the top surface of the bottom rail of the other window sash of a double hung window, whereby the lock and the keeper 12 may engage one another to lock the two window sashes in a shut position (as is generally known in the art and as is also described below).

The description of the present invention below is made in conjunction with the FIG. 1 type prior art lock, with similar components given the same reference numerals. This prior art lock is shown, for example, in U.S. Pat. No. 4,736,972, the complete disclosure of which is hereby incorporated by reference. The present invention could, however, also be used in conjunction with other check rail locks, such as those in which the movable structure is on top of a base secured to the window sash (as is known in, e.g., U.S. Pat. No. 3,811,718), or concealed window locks mounted in recesses in the window sash (as is known in, e.g., U.S. Pat. No. 4,813,725), or in still other check rail lock designs. (The full disclosures of the above two U.S. patents are hereby also fully incorporated by reference). In such cases, it should be recognized that different references for orientations used herein might apply (e.g., the top surface of the sash rail in a concealed lock would, in context, be the surface at the bottom of the recess in which the lock is mounted).

Referring now generally to FIG. 1 and the basic prior art check rail lock 10, the housing 11, which is seen looking toward the underside thereof in FIG. 1, is mounted on the meeting rail of the lower sash of a double-hung window and the keeper 12 is mounted in alignment therewith on the meeting rail of the upper sash. Each of these components can be mounted on their respective meeting rails by fastening means such as screws which can extend through openings 14, 15 of the housing 11 and openings 16, 17 of the keeper 12.

The housing 11 has a top wall 20 and an outer face with a pair of vertical extending contoured lugs 21 and 22 which can coact with a pair of similarly shaped recesses 23 and 24 on an inner face of the keeper 12. These lugs and recesses function to bring the housing and keeper into alignment as the meeting rails come together upon closing the window and, while they may be advantageously used, are examples of the previously mentioned various design features which may be included or excluded with locks incorporating the present invention.

As illustrated in the exploded perspective view of FIG. 2 (in which the basic lock design shown in FIG. 1 is modified to incorporate the present invention), the lock 10 includes a handle 30 having an integral shaft 31 with a rectangular section 32 at the lower end thereof having a pair of axially extending grooves 33 and 34. While a manually manipulable handle 30 is illustrated for moving the lock 10 illustrated in the Figures, it should also be recognized that the present invention could be used with other structures including, for example, motor drives for controlling the lock 10.

Additional movable structure includes a spring washer 35 and a cam 36. Additionally, handle 30 has an orientation lug 69 which positively engages cam 36 at orientation pocket 70 to assure correct assembly location.

The shaft 31 is rotatably mounted within a tubular section 40 of the housing 11 which depends from the top wall 20 with the rectangular section 32 of the shaft extending below the tubular section 40. The spring washer 35 and the cam 36 are mounted on the rectangular section 32 and these parts may be held in assembled relation by a spin deformation of an end of the shaft to provide an enlarged rounded end 42 (see FIG. 1), or other suitable means.

The spring washer 35 is formed as an annular member to surround the rectangular section 32 of the shaft and has a pair of tabs 44 and 45 formed upwardly from the plane of the spring washer 35 for rotational interlocking relation in the axially extending grooves 33 and 34 whereby the spring washer 35 is caused to rotate with the shaft.

The cam 36 has a raised spiral cam flange 50 which in the unlocked position of the check rail lock is disposed within the interior space of the housing 11 and which can be moved to an engaging position behind a locking member 52 on the keeper having a curved surface 53. A strengthening rib 54 having generally the same curvature as the cam flange 50 extends downwardly from the cam 36. The cam has a square opening 55 for mounting on the rectangular section 32 of the shaft.

The tubular section 40 of the housing has a pair of stop shoulders 60 and 61 for coaction with a stop member 62 on the upper surface of the cam 36 whereby the stop member coacts with the stop shoulders to limit rotation of the cam 36 between open and locking positions. The coaction between the stop member 62 and stop shoulder 61 is shown in FIGS. 3–4 when the cam 36 is in locking position.

The spring washer 35 and the tubular section 40 of the housing have coacting detent means for releasably holding the cam 36 in either open or unlocking positions. This detent means includes a pair of diametrically opposite detent notches 65 and 66 formed in an exposed lower face of the tubular section 40 and a pair of diametrically opposite detents 67 and 68 deformed upwardly in the annular body of the spring washer 35 and which engage in the detent notches 65 and 66 when the cam 36 is in either locked or unlocked position. It should also be recognized, however, that such a detent means could be provided by securing the spring washer against pivoting and providing detent notches in the cam.

As is now known in the art from U.S. Pat. No. 4,736,972, the cam can be releasably held in either the open or locking positions by use of spring means in the form of a spring washer which can be assembled onto the shaft with the cam in a single assembly operation and with the spring washer 35 providing dual functions of tolerance take up and releasable locking of the cam. It should further be recognized here that while this detent structure is another example of the previously mentioned various design features which may be included or excluded with locks incorporating the present invention, in the most preferred form of the present invention such a detent structure is advantageous given its ability to provide further security for maintaining the lock 10 in the position desired by the user and to further complicate manipulation of the lock 10 by a potential intruder.

Reference will now be had specifically to the present invention as incorporated into the illustrated check rail lock.

Specifically, as shown in FIGS. 2–3, a guard member 80 is suitably secured to a pivot pin 82 on the underside of the housing 11 for pivoting about a second pivot axis 84 substantially parallel to and spaced from the pivot axis 86 of the cam 36, etc. The guard member 80 includes a slot 88 therein which receives a pin 90 extending from the underside of the cam 36 so that, as described further below, pivoting the cam 36 about the pivot axis 86 will cause the guard member 80 to pivot about the second pivot axis 84.

Operation of the lock 10 is best illustrated in FIGS. 3–4. The lock 10 is shown in its locking position in FIG. 3, with the cam 36 extending out from the housing 11 to a position in which it would cooperate with the keeper 12 on the other sash as previously described. In this position, the slot 88 and pin 90 cooperate to place the guard member 80 in the illustrated guarding position completely underlying the extending portion of the cam 36. As shown in the simplified illustration of FIG. 4, in this position the guard member 80 overlies the gap between the window sashes 96, 98 (the gap being exaggerated for illustration purposes) so that a potential intruder who attempted to insert a knife or other stiff object through the gap between the sashes 96, 98 would be blocked from the cam 36 by the guard member 80.

Further, with the cam 36 in the locking position and the guard member 80 in the guarding position as shown in FIG. 3, it should be appreciated that the slot 88 and pin 90 can be mutually oriented so that a force applied to the guard member 80 (which the potential intruder would conceivably be able to do) would not tend to move the cam 36 toward its open position. That is, since any force applied to the guard member 80 would tend to pivot it about the axis 84 of pin 82, the force transmitted to pivot the cam 36 would be through the side of the slot 88 onto the pin 90. By orienting the slot 88 as shown in FIG. 3, that is, so that it is at its engagement with the pin 90 oriented substantially tangential to the circular path of the pin 90 about the axis 86 (with the force arrow 100 normal to the side of the slot 88 substantially radial to the cam pivot axis 86), the transmitted force will substantially just apply a compressive radial force to the cam 36, with no moment force which would tend to change the position of the cam 36 as would be required to unlock the lock 10. Therefore, manipulation of the guard member 80 by a potential intruder would be fruitless.

Of course, the slot 88 could also be oriented so that any force applied through the guard member 80 to the pin 90 and cam 36 would be overcenter (ie., would tend to bias the cam 36 counterclockwise in FIG. 3 about the axis 84 toward its locking position and away from its open position). Still further, it should be recognized that although not as preferred as the above described structures, the slot 88 and pin 90 could also be oriented to cooperate so that a slight amount of the force transmitted from the guard member 80 to the pin 90 might create a slight clockwise moment in FIG. 3 which would bias the cam 36 toward its open position, although such biasing force would be substantially offset by friction forces between the side of the slot 88 and the pin 90, as well as miscellaneous friction forces in the moving structure, as well as, in the preferred embodiment, the force of the spring washer 35 tending to hold the cam 36 in its locking position. In short, the spirit of the present invention would not be avoided by orienting the components so that a minimal opening force would be applied through the guard member 80 to the cam 36 insufficient to actually move the cam 36 from its locking position to its open position.

During normal operation of a double hung window with which the present invention is used, the handle 30 (or other driving member) would be pivoted (clockwise in FIG. 3) to pivot the cam 36 to its open position completely retracted into the housing 11, with the guard member 80 in its retracted position also completely retracted into the housing 11. The guard member 80 in its retracted position is shown in phantom in FIG. 3. In this configuration, nothing from the lock 10 extends laterally beyond the side of the window sash 96, and therefore the two sashes 96, 98 may be freely moved to any desired position without interference by the lock 10. Pivoting the handle 30 counterclockwise (in the FIG. 3 orientation) thereafter would move the cam 36 back to the locking position shown in FIG. 3, with the pin 90 engaging and moving in the slot 88 to easily simultaneously pivot the guard member 80 back to its guarding position shown in FIG. 3 as well.

It will be appreciated that this structure provides enhanced security and pick protection without requiring any additional actions by the user. Therefore, the lock 10 may be operated by a user in a manner identical to basic check rail locks which people are so familiar with today. Similarly, in motor driven locks this pick protection can be provided without requiring any additional motor drive for this feature beyond the simple drive required merely to rotate the cam 36.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

What is claimed is:

1. A lock securable to one window sash of a double hung window, said lock comprising:

a base securable to the one window sash;

a cam pivotable about a first axis relative to said base between an open position and a locking position, said cam pivoting in a first direction about said first axis when moving from said open position to said locking position and in said locking position including a portion extending from said base and adapted to cooperate with a keeper secured to the other window sash of the double hung window when said base is secured to the one window sash to lock the one window sash in a closed position relative to the other window sash;

a guard member pivotable about a second axis spaced from and substantially parallel to said first axis responsive to pivoting of said cam, said guard member being movable between a guarding position when said cam is in said locking position and a retracted position when said cam is in said open position, where said guard member extends from said base to substantially overlap with said cam extending portion in said guarding position and said guard member does not substantially extend from said base in said retracted position; and a follower connection between said cam and said guard member pivoting said guard member about said second axis between said guarding position and said retracted position when said cam pivots about said first axis between said locking position and said open position, said follower connection being adapted to bias said cam toward pivoting in said first direction when a force biases said guard member toward said retracted position.

2. A lock securable to one window sash of a double hung window, said lock comprising:

a base securable to the one window sash;

a cam pivotable about a first axis relative to said base between an open position and a locking position, said cam in said locking position including a portion extending from said base and adapted to cooperate with a keeper secured to the other window sash of the double hung window when said base is secured to the one window sash to lock the one window sash in a closed position relative to the other window sash;

a guard member pivotable about a second axis spaced from and substantially parallel to said first axis responsive to pivoting of said cam, said guard member being movable between a guarding position when said cam is in said locking position and a retracted position when said cam is in said open position, where said guard member extends from said base to substantially overlap with said cam extending portion in said guarding position and said guard member does not substantially extend from said base in said retracted position; and a follower connection between said cam and said guard member pivoting said guard member about said second axis between said guarding position and said retracted position when said cam pivots about said first axis between said locking position and said open position, said follower connection comprising a pin on one of said cam and said guard member and a slot receiving said pin in the other of said cam and said guard member.

3. The lock of claim 2, wherein said slot is in said guard member and is oriented whereby a force biasing said guard member from said guarding position toward said retracted position biases said pin substantially toward said first axis.

4. The lock of claim 2, wherein said slot is in said guard member and is oriented whereby a force biasing said guard member from said guarding position toward said retracted position biases said pin to introduce a moment force on said cam biasing said cam toward pivoting in a direction away from its open position.

5. A check rail lock securable to the top rail of one window sash of a double hung window, said lock comprising:

a housing securable to the top rail of one window sash;

a cam pivotable about a first axis within said housing between an open position and a locking position, said cam in said locking position including a portion extending from said housing and adapted to cooperate with a keeper secured to the other window sash of the double hung window when said housing is secured to the one window sash to lock the one window sash in a closed position relative to the other window sash;

a pin extending from the bottom of the cam;

a guard member disposed substantially beneath said cam and pivotable about a second axis within said housing spaced from and substantially parallel to said first axis, said guard member having a slot receiving said pin for moving between a guarding position and a retracted position responsive to pivoting of said cam between said locking position and said open position, where said guard member extends from said housing to substantially overlap with said cam extending portion in said guarding position and said guard member is substantially entirely retracted into said housing in said retracted position.

6. The check rail lock of claim 5, wherein said guard member slot is oriented whereby a force biasing said guard member from said guarding position toward said retracted position biases said pin substantially toward said first axis.

7. The check rail lock of claim 5, wherein said slot is in said guard member and is oriented whereby a force biasing said guard member from said guarding position toward said retracted position biases said pin to introduce a moment force on said cam biasing said cam toward pivoting in a direction away from its open position.

8. The check rail lock of claim 5, wherein said cam pivots in a first direction about said first axis when moving from said open position to said locking position and said cam in said locking position positions said pin whereby a force biasing said guard member toward said retracted position engages said pin to bias said cam toward pivoting in said first direction.

9. A lockable double hung window, comprising:

a first window sash including a bottom rail with a top side;

a second window sash including a top rail, said second window sash top rail being positionable adjacent said first window sash bottom rail to define a window shut position;

a keeper secured to the top side of the first window sash bottom rail;

a check rail lock secured to the top rail of the second window sash and including, a cam pivotable between an open position and a locking position about a first axis fixed relative to said second window sash, said cam in said locking position including a portion extending from said top rail to a position interfering with said keeper to restrict movement of one window sash relative to the other window sash, said cam being received in said keeper when said window sashes are in said window shut position, a guard member pivotable relative to said second window sash top rail beneath said cam about a second axis spaced from and substantially parallel to said first axis between a guarding position and a retracted position, said guard member pivoting in a first direction about said first axis when moving from said open position to said locking position, said guard member in said guarding Position overlying both said first and second window sashes beneath said cam extending Portion and said guard member in said retracted position being disposed substantially entirely over the top rail of the second window sash, and a follower connection between said cam and said guard member pivoting said guard member about said second axis between said guarding position and said retracted position when said cam pivots about said first axis between said locking position and said open position, said follower connection being adapted to bias said cam toward pivoting in said first direction when a force biases said guard member toward said retracted position.

10. A lockable double hung window, comprising a first window sash including a bottom rail with a top side;

a second window sash including a top rail, said second window sash top rail being positionable adjacent said first window sash bottom rail to define a window shut position;

a keeper secured to the top side of the first window sash bottom rail;

a check rail lock secured to the top rail of the second window sash and including, a cam pivotable between an open position and a locking position about a first axis fixed relative to said second window sash, said cam in said locking position including a portion extending from said top rail to a position interfering with said keeper to restrict movement of one window sash relative to the other window sash, said cam being received in said keeper when said window sashes are in said window shut position, a guard member pivotable relative to said second window sash top rail beneath said cam about a second axis spaced from and substantially parallel to said first axis between a guarding position and a retracted position, said guard member in said guarding position overlying both said first and second window sashes beneath said cam extending portion and said guard member in said retracted position being disposed substantially entirely over the top rail of the second window sash, and a follower connection between said cam and said guard member pivoting said guard member about said second axis between said guarding position and said retracted position when said cam pivots about said first axis between said locking position and said open position, said follower connection comprising a pin on one of said cam and said guard member and a slot receiving said pin in the other of said cam and said guard member.

11. The double hung window of claim 10, wherein said slot is in said guard member and is oriented whereby a force biasing said guard member from said guarding position toward said retracted position biases said pin substantially toward said first axis.

12. The double hung window of claim 10, wherein said slot is in said guard member and is oriented whereby a force biasing said guard member from said guarding position toward said retracted position biases said pin to introduce a moment force on said cam biasing said cam toward pivoting in a direction away from its open position.

13. The double hung window of claim 9, wherein said check rail lock includes a housing secured to said top rail of said second window sash, said first axis being defined by said housing.

14. The double hung window of claim 13, wherein said housing is open on a side facing said first window sash and said cam extending portion extends out said open side in said locking position and said guard member extends out said open side in said guarding position.

15. The double hung window of claim 14, further comprising a post pivotable about said first axis and extending through an opening in said housing, said post on its lower end being secured to said cam and on its upper end being secured to a manually engageable handle.

* * * * *